US011077696B2

(12) United States Patent
Peleman

(10) Patent No.: US 11,077,696 B2
(45) Date of Patent: Aug. 3, 2021

(54) BINDING FOLDER FOR BINDING LEAVES AND METHOD TO PRODUCE SUCH BINDING FOLDER

(71) Applicant: Unibind Limited, Egkomi (CY)

(72) Inventor: Guido Frans M. Peleman, Knokke-Heist (BE)

(73) Assignee: UNIBIND LIMITED, Egkomi (CY)

( * ) Notice: Subject to any disclaimer, the term of this patent is extended or adjusted under 35 U.S.C. 154(b) by 0 days.

(21) Appl. No.: 17/046,203

(22) PCT Filed: Apr. 10, 2018

(86) PCT No.: PCT/IB2018/052484

§ 371 (c)(1),
(2) Date: Oct. 8, 2020

(87) PCT Pub. No.: WO2019/197875

PCT Pub. Date: Oct. 17, 2019

(65) Prior Publication Data

US 2021/0023869 A1 Jan. 28, 2021

(51) Int. Cl.

| | |
|---|---|
| ***B42D 3/00*** | (2006.01) |
| ***B42C 9/00*** | (2006.01) |
| ***B42F 13/00*** | (2006.01) |

(52) U.S. Cl.
CPC ..... *B42D 3/002* (2013.01); *B42C 9/0056* (2013.01)

(58) Field of Classification Search
CPC ..... B42D 3/002; B42C 9/0056
USPC ..... 281/3.1, 5, 15.1, 21.1, 45; 402/60, 70, 402/71, 73, 74, 75, 79
See application file for complete search history.

(56) References Cited

U.S. PATENT DOCUMENTS 5,779,423 A 7/1998 Bermingham

FOREIGN PATENT DOCUMENTS

| | | | | |
|---|---|---|---|---|
| CN | 101161465 A | | 4/2008 | |
| WO | 2010/061266 A2 | | 6/2010 | |
| WO | WO-2010061266 A2 | * | 6/2010 | ..... B42D 3/002 |
| WO | 2012/168775 A1 | | 12/2012 | |
| WO | 2015/079299 A1 | | 6/2015 | |

OTHER PUBLICATIONS

International Search Report dated Oct. 17, 2019, pertaining to PCT/IB2018/052484, filed Apr. 10, 2018, 4 pages.
Written Opinion dated Oct. 17, 2019, pertaining to PCT/IB2018/052484, filed Apr. 10, 2018, 5 pages.

* cited by examiner

*Primary Examiner* — Justin V Lewis
(74) *Attorney, Agent, or Firm* — Dinsmore & Shohl LLP

(57) ABSTRACT

Binding folder for binding a bundle of leaves, whereby this binding folder comprises a cover with a spine and two endpapers. In the spine a U-shaped profile from heat-conductive material is applied. The U-shaped profile comprises a base and upright arms. In the U-shaped profile a binding adhesive in the form of a hotmelt adhesive is applied. The U-shaped profile in the spine is applied by an assembly adhesive between the upright arms of the U-shaped profile and the spine of the cover. The assembly adhesive extends beyond the free edges of the upright arms and over these free edges.

20 Claims, 4 Drawing Sheets

BINDING FOLDER FOR BINDING LEAVES AND METHOD TO PRODUCE SUCH BINDING FOLDER

CROSS-REFERENCE TO RELATED APPLICATIONS

The present application is the National Phase entry of International Patent Application No. PCT/IB2018/052484 filed Apr. 10, 2018, the entire contents of which are hereby incorporated by reference into this application.

TECHNICAL FIELD

The present disclosure relates to a binding folder for binding leaves.

BACKGROUND

It is known to bind leaves in a thermal binding folder with a cover of cardboard or the like, whereby in the spine of the binding folder a metal spine in the form of a U-shaped profile with a base and upright arms is glued in which a binding adhesive is applied in the form of a hotmelt adhesive.

Such binding folder is used to bind a bundle of leaves, whereby the bundle with a side edge to be bound is put in the U-shaped profile and put into contact with the hotmelt adhesive which by heating the spine of the binding folder is melted, such that the bundle can be pushed in the melted hotmelt adhesive and the hotmelt adhesive penetrates between the leaves, after which the bundle after cooling and setting of the hotmelt adhesive is held in the binding element.

However, a disadvantage of such a metal spine is that the leaves to be bound are caught on or behind the free edges of the arms of the metal spine on the outside of the bundle when applying the bundle in the binding folder.

This means the outer leaves along their edges will stick out of the bound bundle slightly more than the leaves more towards the middle, which affects the look of the binding folder with bound leaves.

An additional disadvantage is that frequently opening and closing the binding folder can cause the cover to detach from or peel off of the metal spine.

In the long term it is also possible the metal profile starts to rust.

These aforementioned disadvantages are detrimental for the look of such a folder, particularly when it is intended for the presentation of a prestigious project or the like.

Another disadvantage of such a metal spine is the danger of injury on the sharp edges and corners of the metal.

SUMMARY

The purpose of the present disclosure is to provide a solution to one or more of the aforementioned and other disadvantages.

The object of the present disclosure is a binding folder for binding a bundle of leaves, whereby this binding folder comprises a continuous cover with a spine and two endpapers, whereby in the spine a U-shaped profile from heat-conductive material is applied, whereby this U-shaped profile comprises a base and upright arms and whereby in the U-shaped profile a binding adhesive in the form of a hotmelt adhesive is applied, whereby the U-shaped profile is applied in the spine by an assembly adhesive between the upright arms of the U-shaped profile and the spine of the cover, whereby this assembly adhesive extends beyond the free edges of the upright arms and over these free edges.

The base of the U-shaped profile can be flat or curved and can have different sizes.

This provides the advantage that the U-shaped profile with the upright arms is firmly lodged against the cover, such that it cannot detach from or □peel off□ the cover.

Moreover, the free edges of the upright arms will be protected against rust because they are covered by the assembly adhesive.

Another advantage is that the outer leaves of the bundle can no longer get caught behind the arms of the profile as the assembly adhesive will prevent this.

Yet another advantage is that the assembly adhesive will shield the sharp edges and corners of the U-shaped profile, such that injuries on these sharp parts can be prevented.

Continuous cover means that the spine and the endpapers of the cover form one whole, or, in other words, that the cover is made of one piece whereby the endpapers continue in the spine.

An advantage of a continuous cover is that composing the binding folder is simpler, resulting in less chances of mistakes.

The disadvantage of separate endpapers is that they can (partially) detach from the edge with which they are affixed to the arms of the spine. This can occur for instance in case of frequent use such that the connection with the endpaper fails or by the partial reactivation of the used assembly adhesive when heating the binding element at the moment you want to melt the binding adhesive. The detaching of an endpaper results in the uselessness of the binding element. Partial detachment is of course not wanted from an aesthetic point of view.

By working with a continuous cover these disadvantages can be avoided.

Moreover, the continuous cover allows the possibility to provide it with a continuous print from the back, over the spine, to the front. This will offer the possibility of nice panoramic prints, mainly on the whole front, without a blank or unprinted edge on the side of the spine.

A binding folder according to the present disclosure comprises two separate elements, namely the U-shaped profile and the continuous cover, which are both produced or manufactured separately before being assembled into the binding folder.

The U-shaped profile is manufactured for example by using a metal plate whereby the binding adhesive in the form of a hotmelt adhesive is applied on its surface. When the binding adhesive is cooled down, the metal plate is formed or pressed into a U-shape.

The second element, the continuous cover, can be provided with preformed creases which will allow the cover to be folded at the right location to open the binding folder once the continuous cover and the U-shaped profile are assembled into the binding folder.

It is of course also possible that the preformed creases are applied at a later stage, i.e. when the assembly adhesive is applied.

According to the present disclosure the assembly adhesive is a non-reactivatable glue, such as e.g. a polyurethane glue.

This provides the advantage that when the binding adhesive is heated to bind leaves in the binding folder, the assembly adhesive will not melt and detach unintentionally again.

Moreover, a non-reactivatable glue provides the advantage that it remains liquid a long time, this means the set time is relatively long, such that there is sufficient time to apply the U-shaped profile in the cover.

Another added advantage of a non-reactivatable glue, such as e.g. a polyurethane glue is that it has a lower melting temperature, such that the binding folder never has to be heated more than the melting temperature of the binding adhesive.

This means thermal damage to the binding folder is excluded.

According to an embodiment of the present disclosure the cover on the inside is laminated with a layer of plastic, such as, for example, a layer of polyvinyl chloride or polyester.

When the cover is made of cardboard, for example, the fibres of the cardboard when using the binding element, even with very compact cardboard, will detach from the cardboard. This means the U-shaped profile will detach from the cover.

This can be avoided using a laminated layer of plastic.

The cover can also be produced from plastic or laminated foil.

In an embodiment a paper layer covers or is glued on the inside of the U-shaped profile.

This provides the advantage that this side too is protected against rust.

The present disclosure also relates to a method to produce a binding folder according to the present disclosure, whereby the method comprises of the following steps:

- the provision of a flat continuous cover comprising of a spine and two endpapers;
- the applying of an assembly adhesive on the inside of the cover in the form of two or more strips extending at a distance from one another and parallel or approximately parallel to each other in the spine of the cover;
- the placing of a U-shaped profile of heat-conductive material in the spine of the cover, in that the U-shaped profile comprises a base and upright arms and whereby in the U-shaped profile a binding adhesive in the form of a hotmelt adhesive is applied;
- the folding up of the endpapers of the cover such that the spine of the cover is folded around and against the U-shaped profile;

whereby the amount of assembly adhesive that is applied on the inside of the cover is chosen such that after folding the cover, the assembly adhesive extends beyond the free edges of the upright arms and over these free edges.

Such method will allow a binding folder to be produced according to the present disclosure.

The afore-mentioned two strips of assembly adhesive as placed such that they will be situated just below the free ends of the upright arms of the U-shaped profile.

Then, both elements of the binding folder, i.e. the cover and the U-shaped profile are assembled by placing the U-shaped profile in the back of the cover.

This assembly can be place in a U-shaped mold or similar with a press to push the U-shaped profile into and against the back of the cover such that the cover is folded around the U-shaped profile.

This assembly has to be performed right after the assembly adhesive is applied to the cover and in time before the assembly adhesive has set.

BRIEF DESCRIPTION OF THE DRAWINGS

With the intention of better showing the characteristics of the present disclosure, a few embodiments of a binding folder according to the present disclosure are described hereinafter by way of an example without any limiting nature, with reference to the accompanying drawings, wherein.

DETAILED DESCRIPTION

Figure 1:
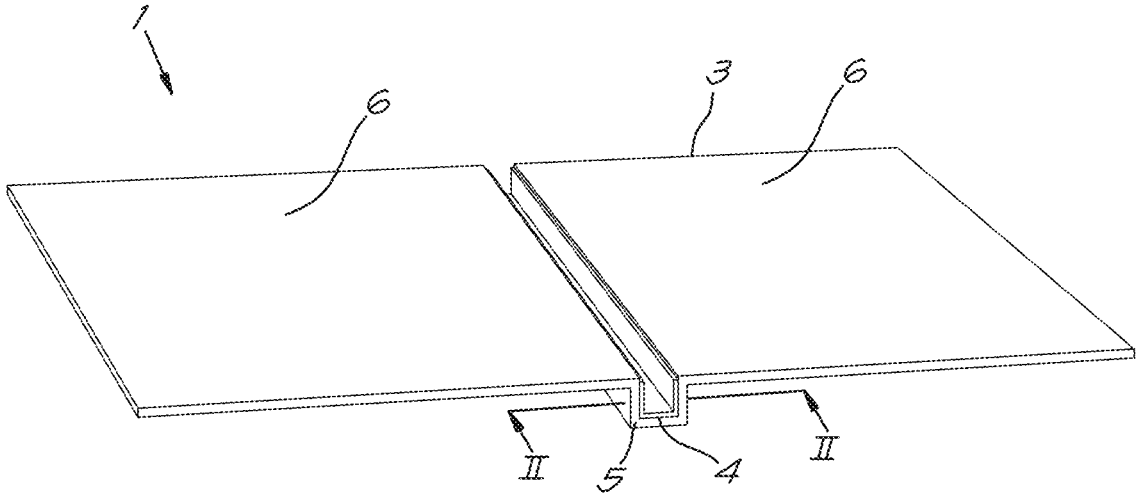
FIG. 1 schematically shows a perspective view of a binding folder according to the present disclosure.

The binding folder 1 for binding a bundle of leaves 2 according to the present disclosure shown in FIG. 1 comprises mainly a continuous cover 3 and a U-shaped profile 4.

The continuous cover 3 comprises a spine 5 with two endpapers 6 affixed or attached to it. In other words, the spine 5 and the two endpapers 6 constitute a whole.

The cover 3 is, for example, made of plastic, such as, for example, polyethylene or polyethylene terephthalate.

A U-shaped profile 4 made of a heat-conductive material is applied in the spine 5 of the cover 3.

In some embodiments, this heat-conductive material is a metal, such as steel for example.

The U-shaped profile 4 contains a base 7 and two upright arms 8.

The base 7 is flat in this case, but could also be curved.

Figure 2:
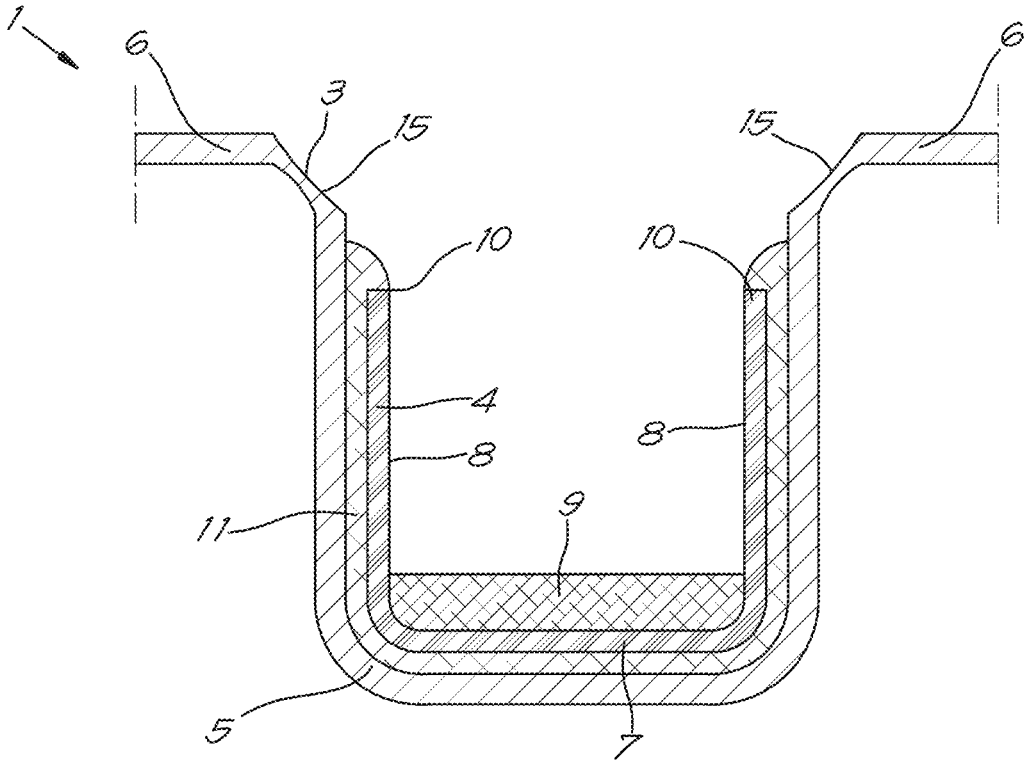
FIG. 2 schematically shows a cross-section according to the line II-II of FIG. 1.

As is clearly shown in the cross-section of FIG. 2, a binding adhesive 9 in the form of a hotmelt adhesive is applied in the profile 4.

Using this binding adhesive 9, a bundle of leaves 2 can be bound in the binding folder 1 by melting the binding adhesive 9.

In some embodiments, the binding adhesive 9 is at least applied on the base 7 of the U-shaped profile 4.

It is not excluded that the binding adhesive 9 is also applied to (a part of) the upright arms 8 of the profile 4.

Moreover, it is also possible that not the entire base 7 is provided with binding adhesive 9, but only a part thereof.

In this case, but not necessarily, the U-shaped profile 4 is made such that free edges 10 of the arms 8 can be folded towards one another.

This provides the advantage that with the same spine size or spine width several thicknesses of bundles of leaves 2 can be bound, in view of the fact that if thinner bundles 2 are used the difference between the thickness of the bundle 2 and the width of the profile 4 can be easily compensated by pressing the arms 8 towards one another up to against the outermost leaves of the bundle 2 so that no open gap can be seen by the user.

In this way one spine width of a binding folder 1 according to the present disclosure can replace five spine widths of a conventional thermal binding folder, for example, such that less stock has to be held.

According to the present disclosure, the U-shaped profile 4 is applied in the spine 5 of the cover 3 by an assembly adhesive 11 between the upright arms 8 of the U-shaped profile 4 and the spine 5 of the cover 3.

According to the present disclosure the assembly adhesive is a non-reactivatable glue, such as e.g. a polyurethane glue or PUR glue.

This provides the advantage that it cannot be activated unintentionally when melting the binding adhesive 9 when binding a bundle of leaves 2.

Moreover, a PUR glue has a long set time, which means there will be enough time to attach the U-shaped profile 4 in the cover 3.

As shown in FIG. 2, this assembly adhesive 11 extends beyond the free edges 10 of the upright arms 8 and the assembly adhesive 11 extends over these free edges 10.

In this way the free edges 10 are covered by the assembly adhesive 11.

Although this is not necessary for the present disclosure, in the shown example the cover 3 is glued over the whole or practically the whole outside surface of the U-shaped profile 4 on the U-shaped profile 4.

This provides the advantage that the U-shaped profile 4 is firmly anchored in the cover 3 and even in case of frequent use cannot detach.

It is also possible that the assembly adhesive 11 is only located at the level of the upright arms 8 of the profile 4, e.g. when an assembly adhesive 11 with very strong adhesive strength is applied or when the binding folder 1 will not be intensively or frequently opened.

The use of a binding folder 1 is very simple and as follows.

By applying heat to the spine 5 of the cover 3, the binding adhesive 9 will turn into liquid.

Because the U-shaped profile 4 is made of heat-conductive material, the heat will quickly penetrate from the cover 3 through the profile 4 and reach the binding adhesive 9.

Because the assembly adhesive 11 is a non-reactivatable glue it will not get softer or start to melt.

When the binding adhesive 9 is liquid, a bundle of leaves 2 can be applied in the spine 5.

Figure 3:
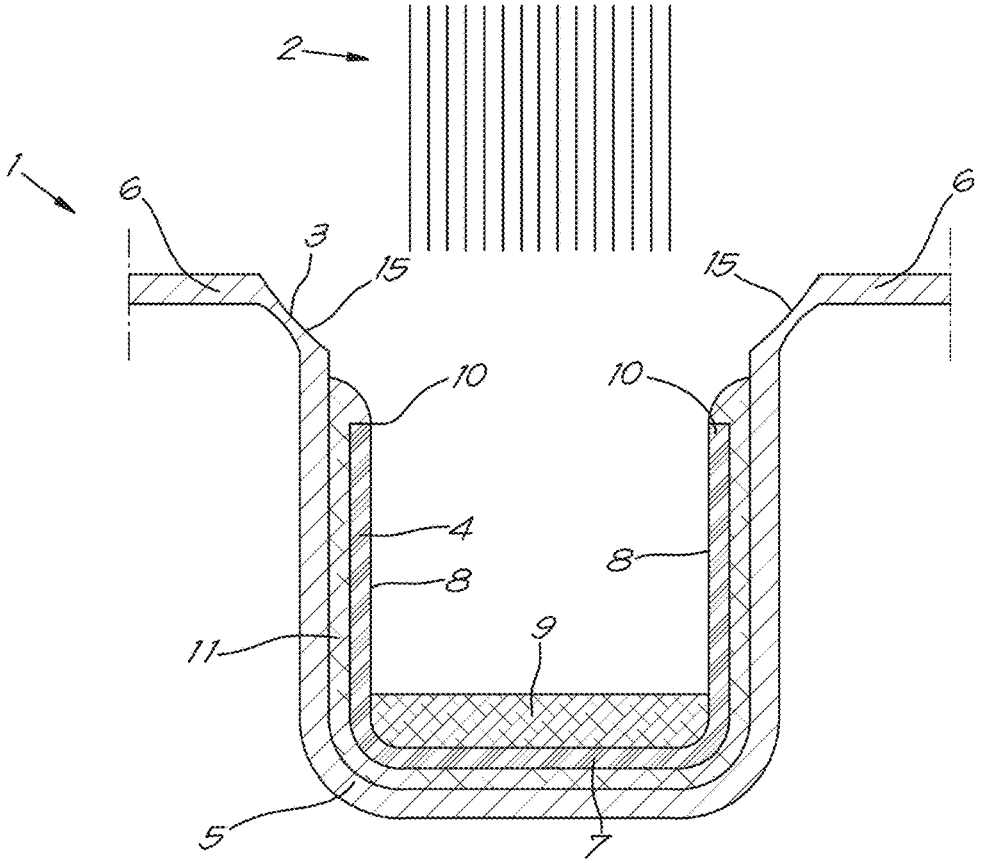
FIG. 3 schematically shows the cross-section of FIG. 2, but with a bound bundle of leaves.

By cooling, the binding adhesive 9 will set and the leaves of the bundle 2 will be bound in the binding folder 1, as shown in FIG. 3.

Possibly the free edges 10 of the upright arms 8 of the U-shaped profile 4 can be folded towards one another, if the bundle of leaves 2 is thinner than the spine width of the binding folder 1.

Figure 4:
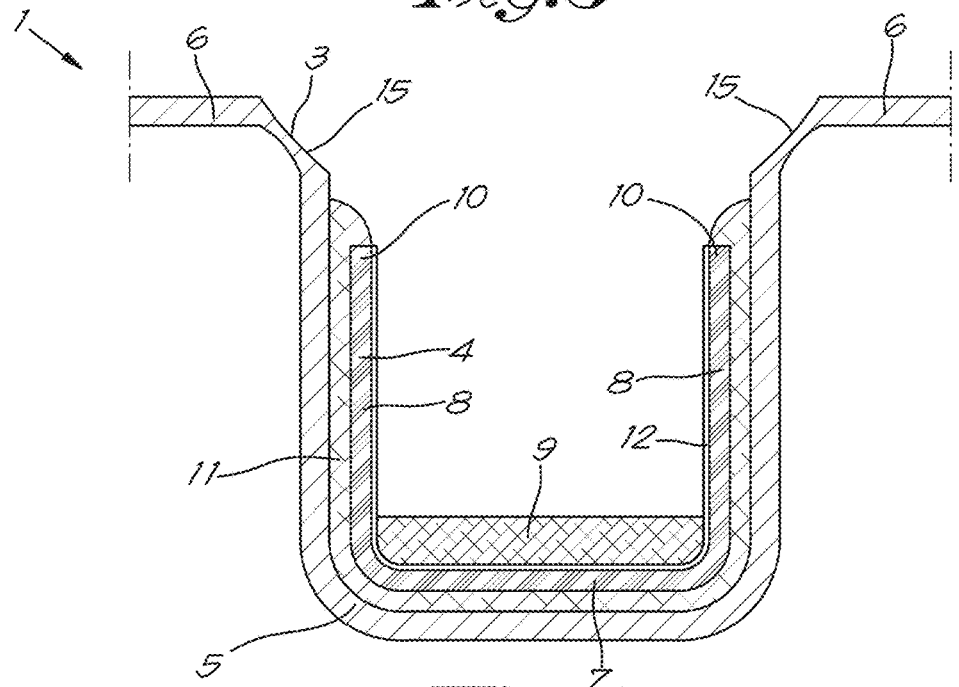
FIG. 4 shows an alternative embodiment of FIG. 2.

FIG. 4 shows a variation according to FIG. 2, whereby in this case a paper layer 12 covers or is glued on the inside of the U-shaped profile 4.

This provides the advantage that the inside of the U-shaped profile 4 is also protected against rust.

As shown in FIG. 4, the binding adhesive 9 is applied on this paper layer 12.

It is clear that this paper layer 12 can be realised in different ways and varieties of paper.

It is also possible that the layer 12 is plastic instead of paper.

Figure 5:
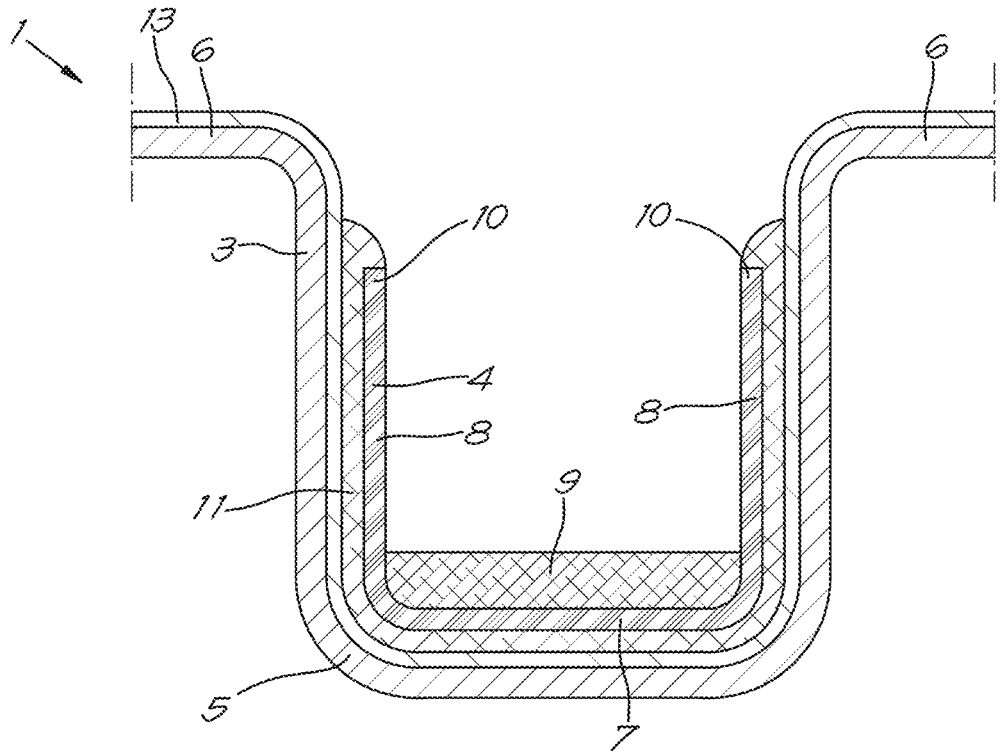
FIG. 5 shows another alternative embodiment of FIG. 2.

FIG. 5 shows a second variant according to FIG. 2, whereby in this case the cover 3 is made from cardboard.

As the fibres of the cardboard when using the binding folder 1 will detach from the cardboard, even with very compact cardboard, the U-shaped profile 4 will detach from the cover 3 as the assembly adhesive 11 will detach from the cover 3 because of the detaching fibres.

That is why in this case the cover 3 on the inside, i.e. the side against which the U-shaped profile 4 is applied, is laminated with a layer of plastic 13.

In this way the assembly adhesive 11 cannot detach from the detaching fibres.

The layer of plastic 13 may be of polyvinyl chloride, PVC, or polyester, for example.

Laminating the cover 3 with a layer of plastic 13 can of course additionally also be done on the outside.

It is also possible to apply this in a cover 3 that is not made of cardboard. In some embodiments, every cover 3 made of a fibre or fibrous material is laminated with a plastic layer 13.

Figure 6:
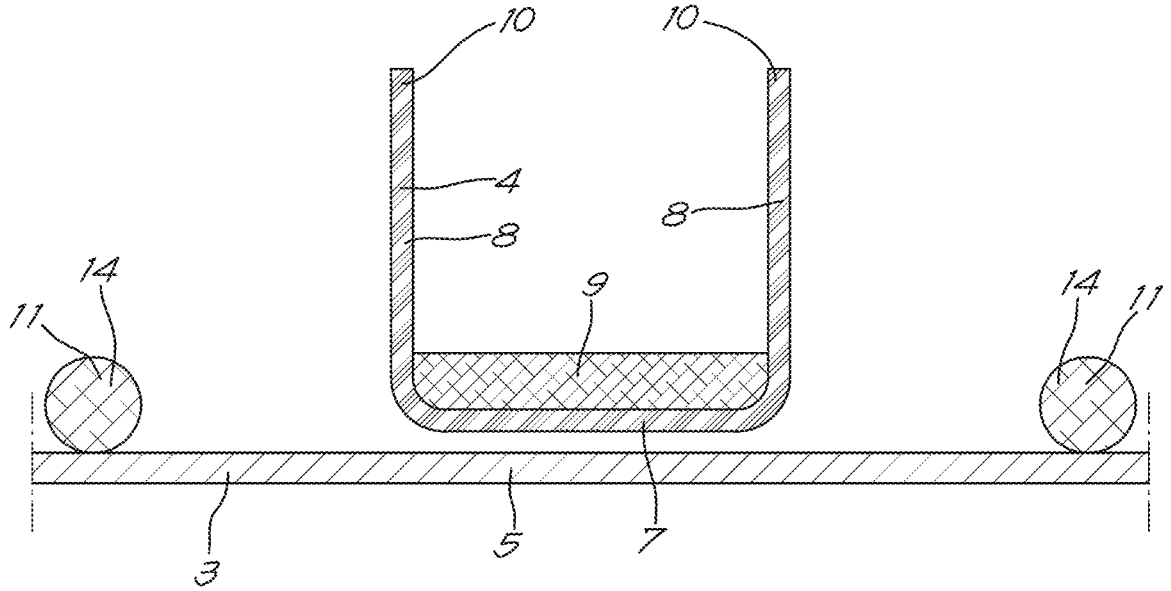
FIG. 6 schematically shows a method to produce a binding folder according to the present disclosure.
Figure 7:
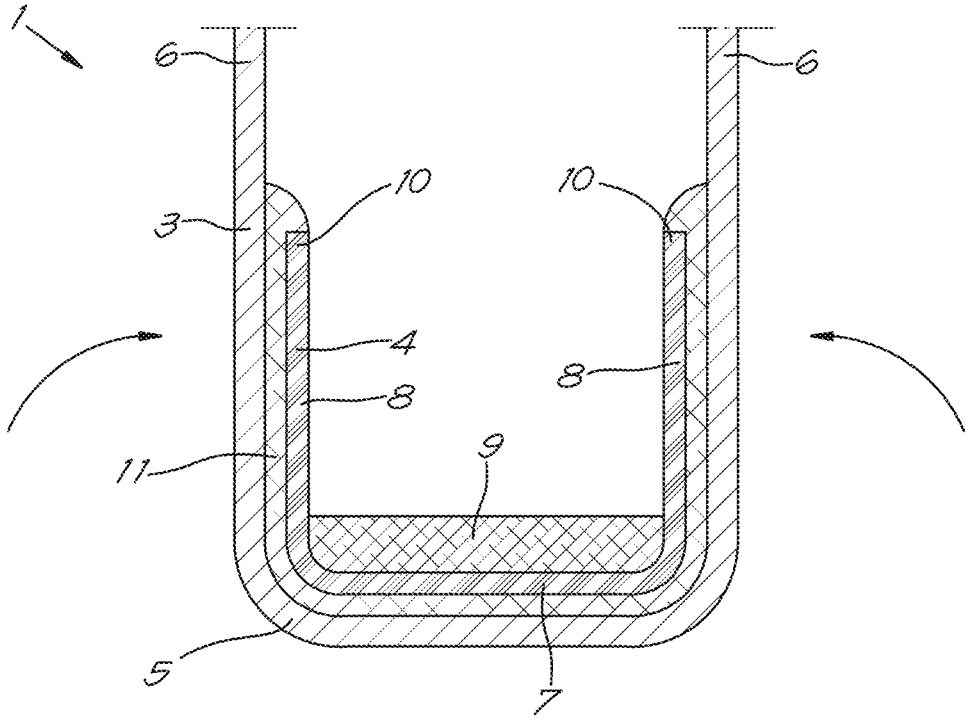
FIG. 7 schematically shows the method to produce the binding folder according to the present disclosure.

The method according to the present disclosure to produce a binding folder 1 in FIG. 1 is shown in FIGS. 6 and 7.

The start is a flat continuous cover 3 consisting of a spine 5 and two endpapers 6.

Flat cover 3 means that the spine 5 is flat and that the endpapers 6 extend in the extension of the spine 5 on either side of the spine 5.

Then, an assembly adhesive 11, e.g. PUR glue is applied on the inside of the cover 3.

The assembly adhesive 11 is applied in the form of two or more strips 14 extending at a distance from one another and parallel or approximately parallel to each other in the spine 5 of the cover 3. It is not excluded there may be more than two strips 14.

In some embodiments, the strips 14 will be applied on the cover 3 at a distance from one another corresponding with the places of the free edges 10 when the spine 5 is folded around the profile 4.

As shown in FIG. 6, the strips 14 have a round cross-section, in other words the strips 14 have a cylindrical shape. This is not necessary for the present disclosure, the strips 14 can also have a rectangular cross-section.

A U-shaped profile 4 made of a heat-conductive material is then put in the spine 5 of the cover 3.

This is also schematically shown in FIG. 6.

A binding adhesive 9 is already applied in this profile 4.

The endpapers 6 of the cover 3 are then folded up such that the spine 5 of the cover 3 is folded around and against the U-shaped profile 4, as shown in FIG. 7.

In some embodiments, the cover 3 is also pressed against the U-shaped profile 4 such that a good adhesion can be obtained.

In some embodiments, the spine 5 of the cover 3 is pressed against the profile 4 until the assembly adhesive 11 is at least 50% set, for example, or at least 75% set.

Care is taken that the amount of assembly adhesive 11 that is applied on the inside of the cover 3 is chosen such that after folding over and pressing the cover 3, the assembly adhesive 11 extends beyond the free edges 10 of the upright arms 8 of the profile 4 and extends over these free edges 10.

If desired a folding line 15, crease or stamped line can then be made in the cover 3 in order to define the endpapers 6 and the folding line over which they can be folded open, in this way a binding folder 1 is formed as shown in FIGS. 1 and 2.

In this way a binding folder 1 is obtained according to the present disclosure.

In some embodiments, the aforementioned U-shaped profile 4 is produced by departing from a sheet of heat-conductive material, whereby a paper layer 12 covers or is glued, optionally, on at least one side of the sheet.

A binding adhesive 9 is then applied in the form of a hotmelt adhesive.

After this the sheet can be shaped into a U-shaped profile 4 such that the binding adhesive 9 is on the inside of the thus shaped U-shaped profile 4.

Such U-shaped profile 4 can be applied in a binding folder 1 and method according to the present disclosure.

Figure 8:
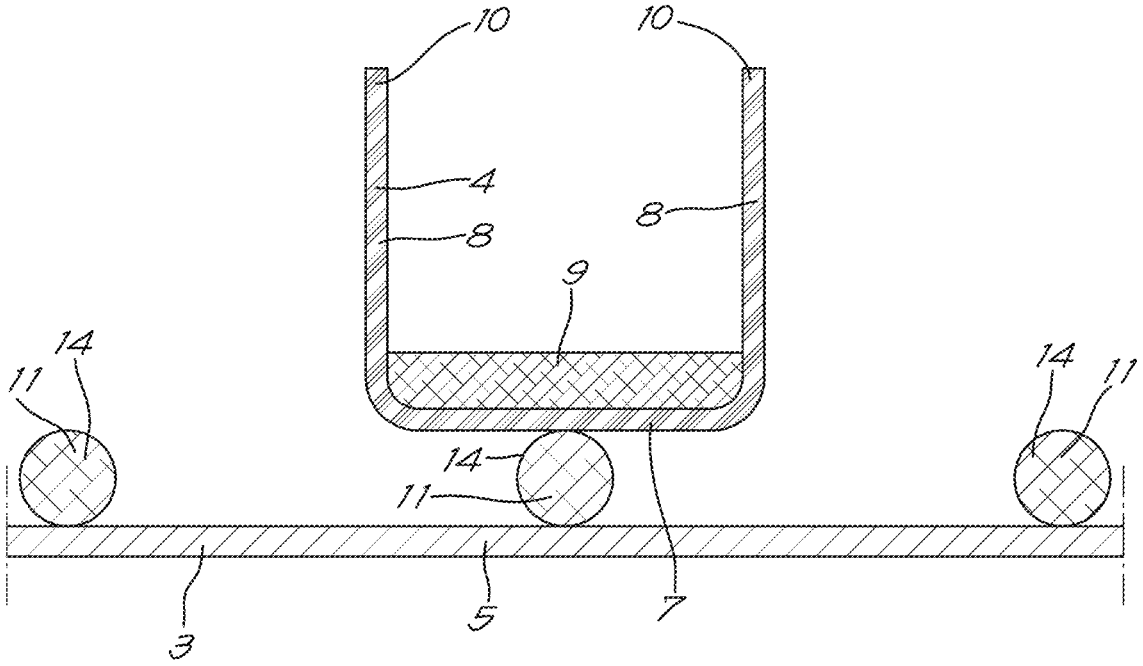
FIG. 8 schematically shows an alternative method to produce a binding folder according to the present disclosure.

In FIG. 8, an alternative method is shown to produce a binding folder 1 is shown.

In this case, the assembly adhesive 11 is applied in the form of three strips 14 at a distance from one another and parallel or approximately parallel to each other in the spine 5 of the cover 3.

The two outermost strips 14 are applied in the same location as in FIG. 6, i.e. corresponding to the places of the free edges 10 when the spine 5 is folded around the profile 4.

The third strip 14 is placed between the two outermost strips 14, corresponding to the location of the base 7 of the profile 4.

When folding up the endpapers 6 of the cover 3, the spine of the cover 3 is folded around and against the U-shaped profile 4.

The three strips 14 of assembly adhesive 11 will be pressed between the cover 3 and the profile 4, such that it will form a continuous layer of assembly adhesive 11 between them, whereby the assembly adhesive 11 will extend beyond the free edges 10 of the upright arms 8 of the profile 4.

The third strip 14 will make sure that no gap is present between the two pressed down outermost strips 14 and that no air is present between the U-shaped profile 4 and the cover 3. In this way, a good contact between the cover 3 and the profile 4 by the assembly adhesive 11 is guaranteed.

The presence of air between the U-shaped profile 4 and the cover 3 should be avoided, because this will limit the heat transport when heating up the binding folder 1 in order to melt the binding adhesive 9.

This can lead to an insufficient melting of the binding adhesive 9, such that the binding of a bundle of leaves 2 cannot be done correctly or sufficiently good. For a good attachment of the bundle of leaves 2 in the profile 4, the binding adhesive 9 has to be molten completely.

Therefore, the presence of a gap with no assembly adhesive 11 between the base 7 of the profile 4 and the back 5 of the cover 3, i.e. the presence of air between the base 7 of the profile 4 and the back 5 of the cover 3, has to be avoided.

By applying the third strip 14, this gap can be avoided. When no such gap is present, a good heat transport or heat conductivity can be guaranteed.

The present disclosure is by no means limited to the embodiments described as an example and shown in the drawings, but a binding folder according to the present disclosure and a method for making such binding folder can be realised according to different variants without departing from the scope of the present disclosure.

The invention claimed is:

1. A binding folder for binding a bundle of leaves, the binding folder comprises a continuous unitary cover with a spine and two endpapers, wherein in the spine a U-shaped profile from heat-conductive material is applied, with the U-shaped profile comprising a base and upright arms and wherein in the U-shaped profile a binding adhesive is applied in a form of a hotmelt adhesive, wherein the U-shaped profile is applied in the spine by an assembly adhesive between the upright arms of the U-shaped profile and the spine of the cover, wherein the assembly adhesive extends beyond free edges of the upright arms and over the free edges, wherein the assembly adhesive is a non-reactivatable glue.

2. The binding folder according to claim 1, wherein the U-shaped profile is made of metal.

3. The binding folder according to claim 1, wherein the binding adhesive is at least applied on the base of the U-shaped profile.

4. The binding folder according to claim 1, wherein the cover is made from cardboard, plastic or laminated foil.

5. The binding folder according to claim 1, wherein the cover is laminated on an inside with a layer of plastic.

6. The binding folder according to claim 5, wherein the layer of plastic is a layer of polyvinyl chloride or polyester.

7. The binding folder according to claim 1, wherein a paper layer covers an inside of the U-shaped profile.

8. The binding folder according to claim 7, wherein the paper layer is glued to the inside of the U-shaped profile.

9. The binding element according to claim 1, wherein the U-shaped profile is made in such a way that the free edges of the upright arms may be folded toward one another.

10. The binding element according to claim 1, wherein the cover is glued over a whole outside surface of the U-shaped profile or a portion of the whole outside surface of the U-shaped profile.

11. The binding folder according to claim 1, wherein the non-reactivatable glue is a polyurethane glue.

12. A method to produce a binding folder, the method comprising: providing a flat continuous unitary cover with a spine and two endpapers;

applying of an assembly adhesive on an inside of the cover in a form of two or more strips extending at a distance from one another and parallel or approximately parallel to each other in the spine of the cover;

placing of a U-shaped profile of heat-conductive material in the spine of the cover, with the U-shaped profile comprising a base and upright arms and in the U-shaped profile a binding adhesive in a form of a hotmelt adhesive is applied;

folding up of the endpapers of the cover such that the spine of the cover is folded around and against the U-shaped profile;

wherein an amount of the assembly adhesive that is applied on the inside of the cover is chosen such that after folding the cover, the assembly adhesive extends beyond free edges of the upright arms and over the free edges.

13. The method according to claim 12, wherein after folding up the endpapers upwards, the spine of the cover is pressed against the U-shaped profile such that an adhesion is obtained.

14. The method according to claim 13, wherein the U-shaped profile is produced from a sheet of heat-conductive material, wherein a paper layer covers or is glued, on at least one side of the sheet, wherein subsequently on the at least one side the binding adhesive in the form of the hotmelt adhesive is applied, after which the sheet is formed into a U-shaped profile such that the hotmelt adhesive is located on an inside of the U-shaped profile.

15. The method according to claim 14, wherein three strips of the assembly adhesive are applied, wherein one strip is placed on a location of the cover corresponding to a location of the base of the U-shaped profile.

16. The method according to claim 13, wherein three strips of the assembly adhesive are applied, wherein one strip is placed on a location of the cover corresponding to a location of the base of the U-shaped profile.

17. The method according to claim 12, wherein the U-shaped profile is produced from a sheet of heat-conductive material, wherein a paper layer covers on at least one side of the sheet, wherein subsequently on the at least one side the binding adhesive in the form of the hotmelt adhesive is applied, after which the sheet is formed into a U-shaped profile such that the hotmelt adhesive is located on an inside of the U-shaped profile.

18. The method according to claim 17, wherein three strips of the assembly adhesive are applied, wherein one strip is placed on a location of the cover corresponding to a location of the base of the U-shaped profile.

19. The method according to claim 17, wherein the paper layer is glued to the at least one side of the sheet.

20. The method according to claim 12, wherein three strips of the assembly adhesive are applied, wherein one strip is placed on a location of the cover corresponding to a location of the base of the U-shaped profile.

* * * * *